US012623317B2

(12) United States Patent
Hou et al.

(10) Patent No.: US 12,623,317 B2
(45) Date of Patent: May 12, 2026

(54) POLISHING TOOL AND METHOD

(71) Applicant: Taiwan Semiconductor Manufacturing Company, Ltd., Hsinchu (TW)

(72) Inventors: Te-Chien Hou, Kaohsiung City (TW); Chi-hsiang Shen, Tainan City (TW); Chen-Chi Tang, Hsinchu City (TW); Shich-Chang Suen, Hsinchu City (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 407 days.

(21) Appl. No.: 18/318,579

(22) Filed: May 16, 2023

(65) Prior Publication Data

US 2024/0383092 A1 Nov. 21, 2024

(51) Int. Cl.
*B24B 37/04* (2012.01)
*B24B 37/32* (2012.01)

(52) U.S. Cl.
CPC ..... *B24B 37/042* (2013.01); *B24B 37/32* (2013.01)

(58) Field of Classification Search
CPC ..... B24B 7/228; B24B 37/005; B24B 37/015; B24B 37/04; B24B 37/042; B24B 37/07; B24B 37/10; B24B 37/105; B24B 57/02
See application file for complete search history.

(56) References Cited

U.S. PATENT DOCUMENTS 5,795,218 A * 8/1998 Doan ..... B24B 37/26 451/526
5,853,317 A * 12/1998 Yamamoto ..... B24B 37/22 451/526
6,530,829 B1 * 3/2003 Kramer ..... B24B 37/26 451/526
6,692,338 B1 * 2/2004 Kirchner ..... B24B 37/26 451/60
2006/0030156 A1 * 2/2006 Butterfield ..... B23H 5/08 438/689
2016/0107287 A1 * 4/2016 Bajaj ..... B24B 37/24 51/298
2020/0055161 A1 * 2/2020 Chockalingham ..... B24B 37/26
2020/0361053 A1 * 11/2020 Tien ..... B24B 37/20
2021/0053180 A1 * 2/2021 Yen ..... B24B 37/042
2022/0250203 A1 * 8/2022 Jawali ..... B33Y 40/20

FOREIGN PATENT DOCUMENTS

WO WO-0124969 A2 * 4/2001 ..... B24D 13/14

* cited by examiner

*Primary Examiner* — Joel D Crandall
(74) *Attorney, Agent, or Firm* — Ingrassia Fisher & Lorenz, LLP

(57) ABSTRACT

Provided is a polishing tool and a methods for polishing a wafer or manufacturing a semiconductor device. A method for polishing a wafer includes contacting a surface of the wafer to a polishing pad at an interface; rotating the wafer and/or the pad; and delivering a series of selected treatment agents to the interface and removing waste from the interface through channels extending through the pad, while controlling a rate of delivering the selected polishing agents and removing the waste streams through the channels formed in the pad to optimize polishing of the wafer.

20 Claims, 7 Drawing Sheets

POLISHING TOOL AND METHOD

BACKGROUND

Semiconductor or integrated circuit (IC) devices are constructed using complex fabrication processes that form a plurality of different layers on top of one another. Many of the layers are patterned using photolithography, in which a light sensitive photoresist material is selectively exposed to light. For example, photolithography is used to define back-end metallization layers that are formed on top of one another. To ensure that the metallization layers are formed with a good structural definition, the patterned light must be properly focused. To properly focus the pattered light, a workpiece must be substantially planar to avoid depth of focus problems.

Chemical mechanical polishing (CMP) is a widely used process by which both chemical and mechanical forces are used to globally planarize a semiconductor workpiece. The planarization prepares the workpiece for the formation of a subsequent layer. A typical CMP tool comprises a rotating platen covered by a polishing pad. A slurry distribution system is configured to provide a polishing mixture, having chemical and abrasive components, to the polishing pad. A workpiece is then brought into contact with the rotating polishing pad to planarize the workpiece. CMP is a favored process because it achieves global planarization across the entire wafer surface. The CMP process polishes and removes materials from the wafer, and works on multi-material surfaces. Furthermore, the CMP process avoids the use of hazardous gasses, and/or is usually a low-cost process.

BRIEF DESCRIPTION OF THE DRAWINGS

Aspects of the present disclosure are best understood from the following detailed description when read with the accompanying figures. It should be noted that, in accordance with the standard practice in the industry, various features may not be drawn to scale. In fact, the dimensions of the various features may be arbitrarily increased or reduced for clarity of discussion.

DETAILED DESCRIPTION

Figure 1:
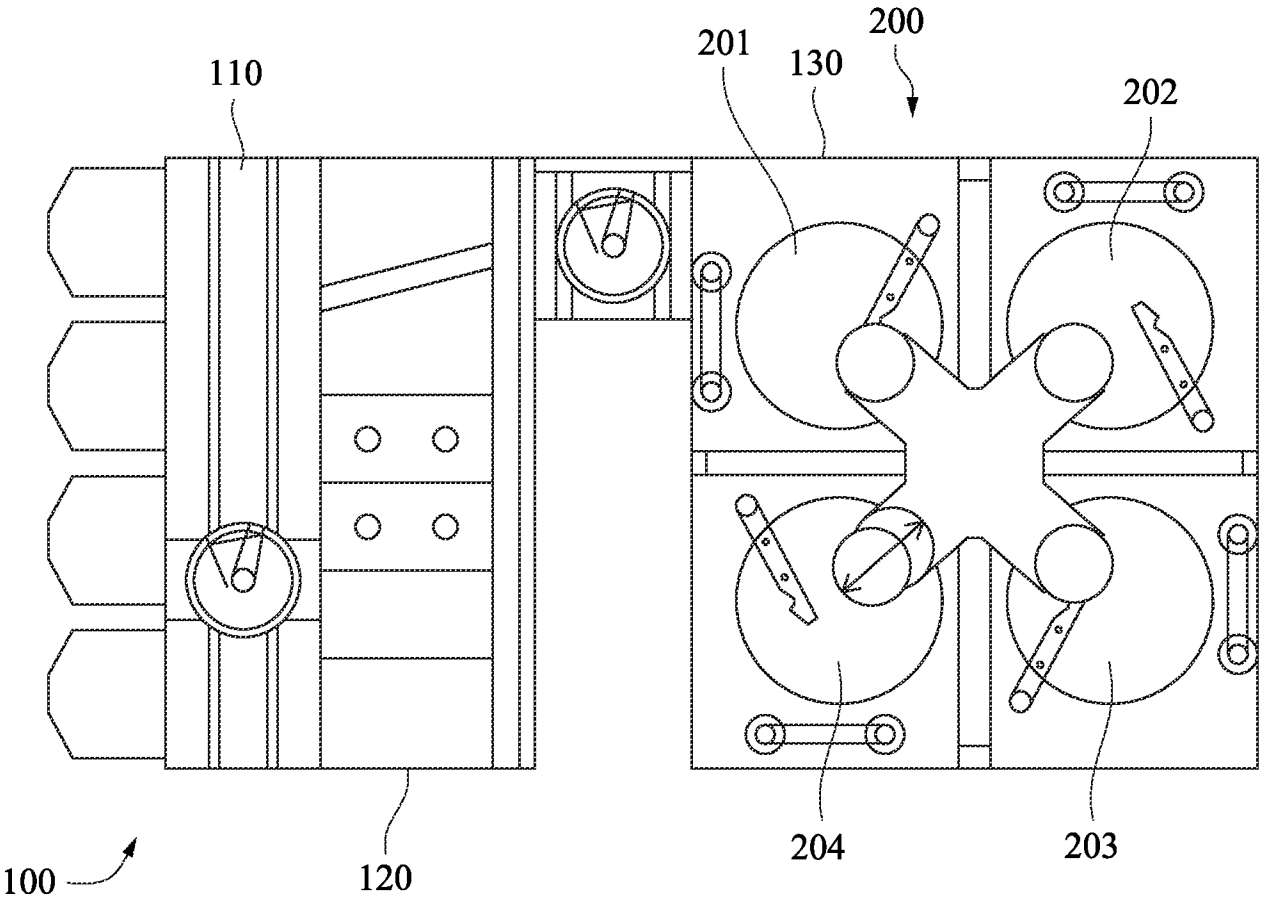
FIG. 1 is a schematic view of a Chemical Mechanical Polishing (CMP) tool in accordance with some embodiments.

The following disclosure provides many different embodiments, or examples, for implementing different features of the subject matter provided. Specific examples of components and arrangements are described below to simplify the present disclosure. These are, of course, merely examples and are not intended to be limiting.

For the sake of brevity, conventional techniques related to conventional semiconductor device fabrication may not be described in detail herein. Moreover, the various tasks and processes described herein may be incorporated into a more comprehensive procedure or process having additional functionality not described in detail herein. In particular, various processes in the fabrication of semiconductor devices are well-known and so, in the interest of brevity, many conventional processes will only be mentioned briefly herein or will be omitted entirely without providing the well-known process details. As will be readily apparent to those skilled in the art upon a complete reading of the disclosure, the structures disclosed herein may be employed with a variety of technologies, and may be incorporated into a variety of semiconductor devices and products. Further, it is noted that semiconductor device structures include a varying number of components and that single components shown in the illustrations may be representative of multiple components.

Furthermore, spatially relative terms, such as "over", "overlying", "above", "upper", "top", "under", "underlying", "below", "lower", "bottom", and the like, may be used herein for ease of description to describe one element's or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When a spatially relative term, such as those listed above, is used to describe a first element with respect to a second element, the first element may be directly on the other element, or intervening elements or layers may be present. When an element or layer is referred to as being "on" another element or layer, it is directly on and in contact with the other element or layer.

In addition, the present disclosure may repeat reference numerals and/or letters in the various examples. This repetition is for the purpose of simplicity and clarity and does not in itself dictate a relationship between the various embodiments and/or configurations discussed.

FIG. 1 is a schematic view of a Chemical Mechanical Polishing (CMP) device or tool 100. The tool 100 is configured for performing a CMP process on a wafer in a semiconductor manufacturing process. The CMP tool 100 may include a wafer transportation unit 110, a cleaning unit 120, and a polishing unit 130. Typically, the wafer transportation unit 110 transports a wafer to the polishing unit 130, where the wafer is polished. Thereafter, the wafer transportation unit 110 transports the wafer to the cleaning unit 120, wherein the wafer is cleaned.

Figure 2:
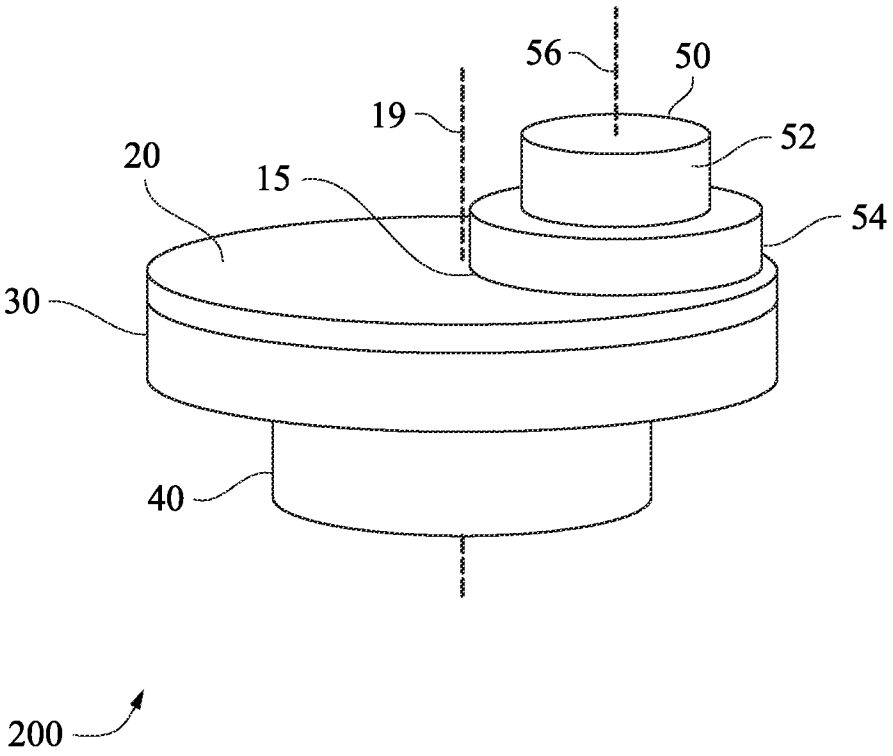
FIG. 2 is a perspective view of a polishing location in the CMP tool of FIG. 1 in accordance with some embodiments.

As shown, a polishing unit 130 may include four polish locations or modules 200 where the unit 130 may perform a CMP operation on a wafer. For example, the polishing unit 200 may include a first main polish module 201, a second main polish module 202, a first chemical buff module 203, and a second chemical buff module 204. In certain embodiments, during operation of the polishing tool 100, a wafer may be processed in succession by each module 200. In certain embodiments, during operation of the polishing tool 100, a first wafer may be processed by the first main polish module 201 and then by the first chemical buff module 203 while a second wafer may be processed by the second main polish module 202, and then by the second chemical buff module 204. While FIG. 2 illustrates four polish modules 200, any suitable number of polish modules 200 may be employed.

Embodiments herein involve chemical mechanical polishing (CMP) processes and CMP tools such as the tool of FIG. 1. CMP is a method of planarizing or flattening out a semiconductor wafer surface by polishing away a thin layer of wafer surface. CMP tools typically use CMP polishing pads made out of porous materials. During operation, by-products of the CMP process may become embedded into the treatment surface of the porous material. As the treatment surface of the porous pad is brought into contact with a subsequent semiconductor workpiece the embedded by-products can scratch the workpiece, causing defects in an integrated chip. Such defects pose an increasing problem to semiconductor yields as the minimum features sizes implemented on the workpieces decrease.

For example, over time slurry accumulation and smoothing of a CMP polishing pad cause a degradation of the polishing rate and planarity achieved by a CMP tool. To maintain a high degree of planarity, many modern CMP tools use an abrasive conditioning pad to condition the CMP polishing pad. The abrasive conditioning pad often comprises a diamond grit and is connected to a conditioning arm, which moves back and forth across a CMP polishing pad to condition the polishing pad as it rotates. As workpiece sizes have increased, for example to 300 mm or 450 mm, larger CMP polishing pads are used, requiring conditioning tools to condition larger areas. This may lead to an increase in diamond grit breaking off of the conditioning pad and scratching of a workpiece.

Abrasives/by-products/slurry residue left on polish pad can cause wafer scratch defects, including deep scratch and micro scratch defects, and remain/hump defects. Severe scratch and remain/hump defects will lead to pattern fail and electrical reliability issues.

Accordingly, some aspects of the present disclosure provide for an improved method and device for removing debris, such as abrasive or slurry residue, or by-products, such as oxides, nitrides, or metals, from a treatment surface of a polishing pad to enhance pad cleaning so as to prevent wafer scratches and contamination in chemical mechanical polishing (CMP) processes. In some embodiments, a treatment agent source is provided in fluid communication with the treatment surface of the polishing pad via a channel through the polishing pad. In certain embodiments, the treatment agent source is provided in fluid communication with the treatment surface of the polishing pad via a channel through the platen on which the polishing pad is located.

Certain embodiments herein provide for enhancing slurry flow distribution with an engineered three-dimensional printed polish pad using as many as seven types of slurry/chemical systems, a drain system, and three types of polish strategy combination, thus increasing within-wafer (WiW) and within-zone (WiZ) uniformity control and defectivity performance for yield and electrical property benefit.

It is noted that polishing of semiconductor wafers may be analyzed by zones within the wafer surface. For example, a central zone may be circular and include the center of the wafer to a radius of 40 mm. A next zone may be annular and include the area from a radius of 40 mm to a radius of 70 mm. A next zone may be annular and include the area from a radius of 70 mm to a radius of 95 mm. A next zone may be annular and include the area from a radius of 95 mm to a radius of 122 mm. A next zone may be annular and include the area from a radius of 122 mm to a radius of 138 mm. A next zone may be annular and include the area from a radius of 138 mm to a radius of 145 mm. A last zone may be annular and include the area from a radius of 145 mm to a radius of 150 mm, or to the edge of the wafer.

Poor slurry/chemical distribution leads to worse WiW uniformity, which may be compensated for by downforce (DF) setting modification in the short term. Specifically, the downforce on each zone of the wafer may by tuned and differ during a polishing process. A poor downforce application may result in an increase in defects. Determining an optimal distribution and flow of slurry and or chemical may be conducted by software simulation.

Nevertheless, current processes for applying slurry and/or chemical to a polishing pad may not meet optimal distribution and flow and result in poor zone-to-zone (WiW) uniformity.

While downforce may be tuned to improve WiW uniformity, WiZ thickness uniformity is difficult to control by downforce or other tool settings.

As semiconductor technology node advances to five nm and beyond, WiW and WiZ thickness uniformity and defectivity are much more stringent than ever before. Poor CMP uniformity and increased numbers of defects can lead to circuit failure, thus degrading chip yield and electrical characteristics. CMP processes are limited for WiW and WiZ uniformity and defectivity control due to limited slurry/chemical distribution.

Thus, the tool 100 described herein is provided with a slurry dispensing arrangement and three-dimensional printed micro-structured polish pad to achieve uniform slurry distribution supply and rapid draining of used or waste slurry. Specifically, the tool 100 is provided with a bottom-up fresh slurry supply and top-down waste slurry drain system. With this system, advanced CMP processing is enabled with increasing uniformity control and reductions in defectivity, which in turn result in high yield quality.

FIG. 2 is a schematic view of a Chemical Mechanical Polishing (CMP) polish module 200. The module 200 is configured for performing a CMP process on a wafer 15 in a semiconductor manufacturing process. As shown, the module 200 includes a polishing pad 20, a platen 30, a platen motor 40, and a wafer holder assembly 50, in accordance with some embodiments. The elements of the polish module 200 can be added to or omitted, and the disclosure should not be limited by the embodiments.

The platen 30 is configured to receive and rotate the polishing pad 20 about a center axis 19. In some embodiments, the platen 30 is circular in shape. The diameter of the platen 30 lies in a range that is substantially larger than the diameter of a wafer 15 to be polished.

The platen motor 40 rotates the platen 30 about the axis 19. The platen motor 40 may be electrically connected to a control module in the CMP tool and may be actuated and operated by the control module.

In an embodiment, the polishing pad 20 is fixed onto the platen 30. The polishing pad 20 may be a consumable item used in a semiconductor wafer fabrication process. A polishing pad 20 may be a hard, incompressible pad or a soft pad. For oxide polishing, hard and stiffer pads are generally used to achieve planarity. Softer pads are generally used in other polishing processes to achieve improved uniformity and a smooth surface. Hard pad and soft pad components may also be combined in an arrangement for customized applications.

For example, in certain embodiments, the polishing pad 20 may be formed by three-dimensional printing with desired portions formed from hard material and desired portions formed from soft material, or formed with other desired attributes. In some embodiments, the polishing pad 20 is formed with a channel or channels as described below.

The wafer holder assembly 50 is used to support the wafer 15. In some embodiments, the wafer holder assembly 50 may include a shaft with a driving motor (not shown), a carrier head 52, and a retention ring 54. The driving motor may be configured to control rotational movement of the carrier head 52 and retention ring 54 about a rotation axis 56. The rotation axis 56 is different from the rotation axis 19. In some embodiments, the driving motor is an electric motor which converts electrical energy into mechanical energy for driving the rotation of the carrier head 52 and retention ring 54. In some embodiments, the carrier head 52 and retention ring 54 are driven to rotate about the rotation axis 56 by an external force (e.g., frictional force generated between the polishing pad 20 and the wafer 15).

Referring to FIGS. 3-6, the structure of the wafer holder assembly 50 is shown more clearly. As shown, the carrier head 52 has a bottom surface 61 and an outer perimeter 62. The retention ring 54 has an annular shape and is mounted on the outer perimeter 62 of the carrier head 52. Further, the retention ring 54 has an inner surface 65, such as a cylindrical surface 65, and extends downward to a terminal surface 66 at a distance from the bottom surface 61 of the carrier head 52. As a result, a recess or pocket 67 is defined by the wafer holder assembly 50, below the bottom surface 61 of the head 52, above the terminal surface 66 of the retention ring 54, and inside of the inner surface 65 of the retention ring 54.

While FIGS. 3-6 illustrate the retention ring 54 located outside the periphery of the carrier head 52, other designs are envisioned. For example, the carrier head 52 may be formed with an inner cylindrical wall surface and the retention ring 54 may be positioned inside of such wall surface. Further, a retention ring cushion may be positioned between the retention ring 54 and the carrier head 52 to cushion movement therebetween.

As further shown, the wafer holder assembly 50 may include a flexible membrane 58. Flexible membrane 58 is used to provide a flat surface for securing a wafer 15 to the carrier head 52.

Though not shown, the wafer holder assembly 50 may further include a port or ports to the pocket 67 for applying a positive pressure to an internal surface of flexible membrane 58 in order to help maintain a flat surface for supporting wafer 15 and to evenly distribute pressure applied to the wafer 15.

Further, though not shown, the wafer holder assembly 50 may include a port or ports for applying a negative pressure to an external surface of flexible membrane 58 in order to hold the wafer 15 with the wafer holder assembly 50. When the wafer 15 is to be released from the wafer holder assembly 50, such as following a polishing process, the negative pressure may be released or a positive pressure may be applied.

Thus, the wafer holder assembly 50 is configured pick up a wafer 15, transport the wafer 15, and hold the wafer 15 against polishing pad 20. Carrier head 52 may be capable of moving in a direction perpendicular to a polishing surface of polishing pad 20 in order to adjust a pressure applied to wafer 15 during the polishing process. A membrane support structure may be positioned in the pocket 67 to provide support for membrane 58 during the polishing process. Retention ring 54 is used to reduce lateral movement of wafer 15 during the polishing process. In order to reduce lateral movement of wafer 15, retention ring 54 may be pressed against polishing pad 20.

Figure 3:
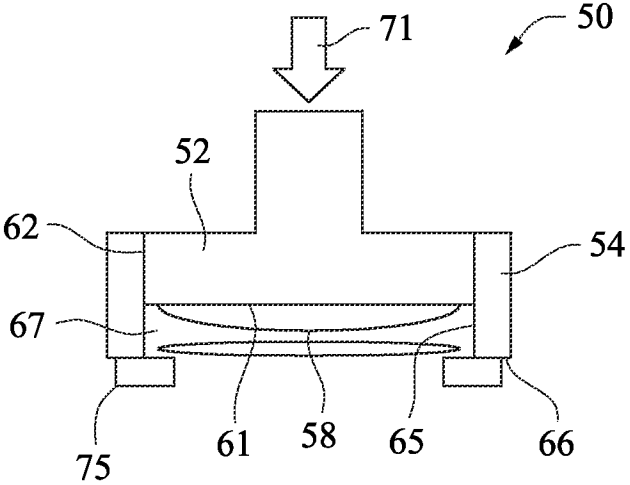

In FIG. 3, the wafer holder assembly 50 is moved in the direction of arrow 71 toward wafer 15. As shown wafer 15 is supported by a wafer tray 75. The retention ring 54 of the wafer holder assembly 50 may be moved into contact with the wafer tray 75. Then, the membrane 58 may be operated to contact the wafer 15 and draw the wafer 15 against the membrane 58, such as through the selective application of positive and negative pressure.

Figure 4:
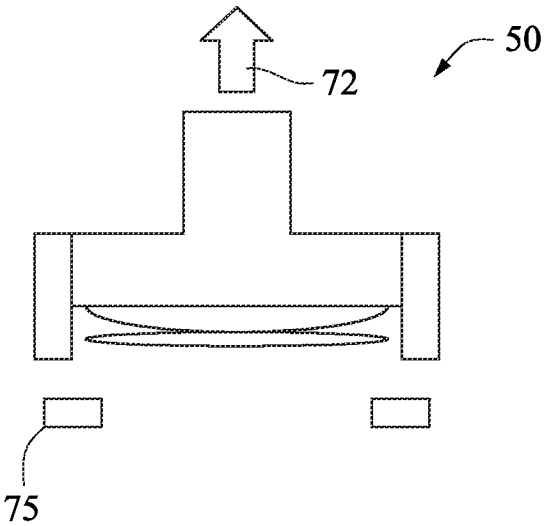
FIGS. 3-6 are cross-sectional schematic view of a wafer being transported to, and polished at, a polishing location in accordance with some embodiments.

In FIG. 4, the wafer holder assembly 50 is lifted in the direction of arrow 72. As shown, the wafer 15 is removed from the wafer tray 75 and is carried by the wafer holder assembly 50. With cross-reference to FIG. 2, the wafer holder assembly 50 may carry the wafer 15 to a polishing pad 20.

Figure 5:
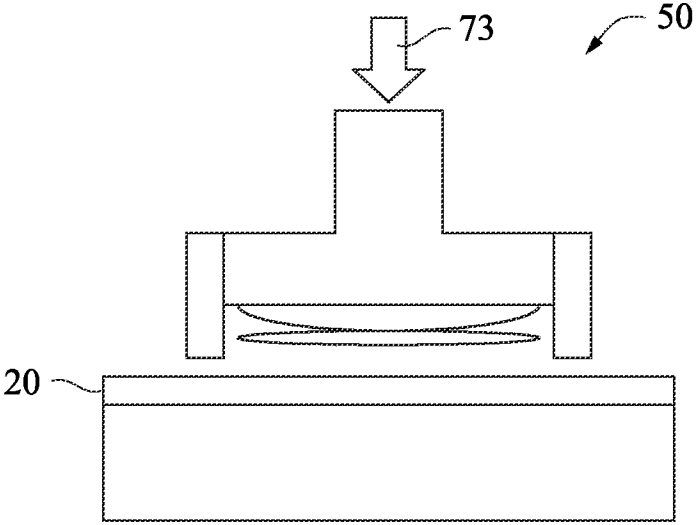

In FIG. 5, the wafer holder assembly 50 is moved in the direction of arrow 73 toward the polishing pad 20, and may be moved into contact with the polishing pad 20.

Figure 6:
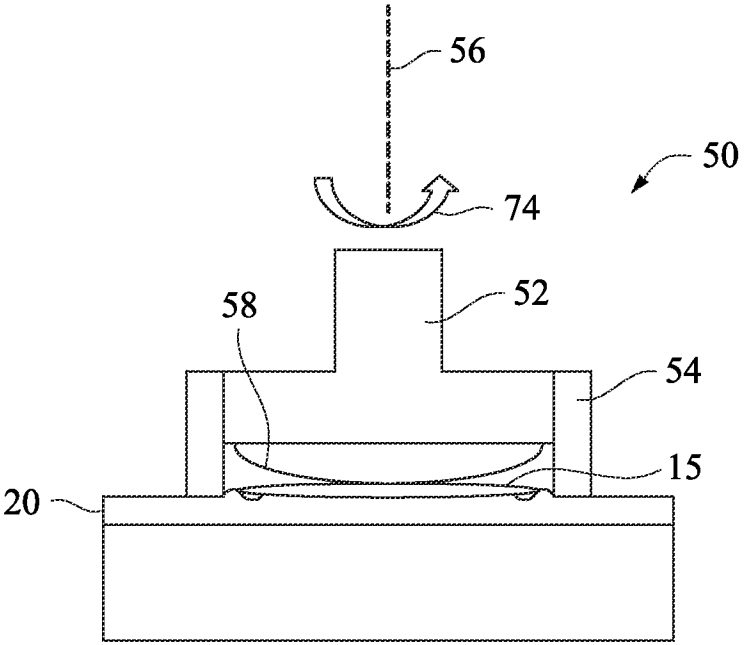

In FIG. 6, the wafer holder assembly 50 is in contact with the polishing pad 20 and may be rotated about axis 56, such as in the direction of arrow 74, during a polishing process. As shown, the retention ring 54 may contact the polishing pad 20 during the polishing process. Further, the membrane 58 and/or carrier head 52 may impart a desired pressure to the wafer 15 against the polishing pad 20.

Figure 7:
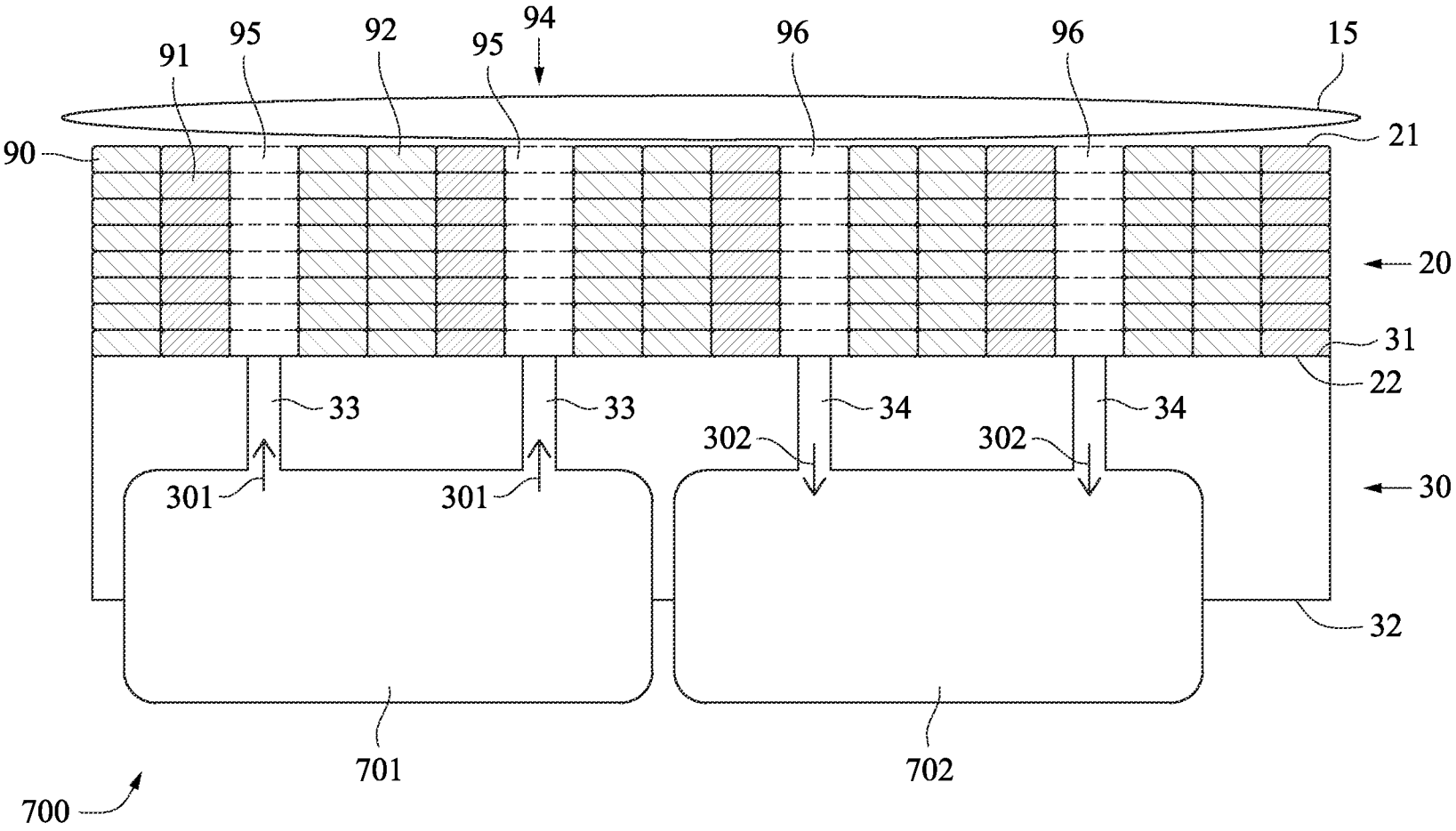
FIG. 7 is cross-sectional schematic view of a wafer, polishing pad, and platen at a polishing location in accordance with some embodiments.

Referring now to FIG. 7, a rotatable structure 700 including a polishing pad 20 and platen 30 is illustrated while supporting a wafer 15. The polishing pad 20 includes a treatment or polishing surface 21 and an opposite surface 22 that is located on and supported by the platen 30. Likewise, the platen 30 includes a top surface 31, which supports the polishing pad 20, and an opposite surface 32.

In some embodiments, the polishing pad 20 is formed from pixels or grains 90 that are fused during a three-dimensional printing process. Through use of three-dimensional printing, the hardness and other properties of the polishing pad 20 may be controlled at a pixel level. Specifically each hard/soft/void pad material fraction can be manufactured by three-dimensional printing technology providing for pixel-level precision control. For example, the grains 90 may include hard material grains 91 and soft material grains 92. In certain embodiments the hardness of the grains 90 may range from about 5 shore A to about 80 shore D. Shore durometer is a hardness measurement unit as well as the term used to refer to the measuring tool. Shore durometer is used to measure hardness of polymers, elastomers and rubbers. Shore durometers are measured on several scales. The shore A scale is used for softer materials, and the shore D scale is used for harder materials. Herein, the hard material has a greater or higher hardness than the soft material. The grain 90 may comprise materials suitable for three-dimensional printing, such as polyimides, acrylics, polyesters and other materials.

As further shown, the grains are arranged such that the polishing pad 20 is formed with columns 94 of material and columns 95 and 96 of aligned voids or channels 95 and 96. As shown, the columns 94 and 95 extend from surface 21 to surface 22. Thus, the channels 95 provide a flow path through the polishing pad 20. In some embodiments, the channels 95 and 96 have a diameter or width perpendicular to a flow path direction that is at least 0.01 mm, such as at least 0.05 mm, at least 0.1 mm, at least 0.2 mm, at least 0.3 mm, at least 0.4 mm, at least 0.5 mm, at least 0.6 mm, at least 0.7 mm, at least 0.8 mm, at least 0.9 mm, such as at least 1 mm. In some embodiments, the channels 95 and 96 have a diameter or width perpendicular to a flow path direction that is at most 0.01 mm, such as at most 0.1 mm, at most 0.2 mm, at most 0.3 mm, at most 0.4 mm, at most 0.5 mm, at most 0.6 mm, at most 0.7 mm, at most 0.8 mm, at most 0.9 mm, or at most 1 mm.

Likewise, the platen 30 is formed with channels 33 and channels 34 that extend to the top surface 31 from the opposite surface 32. As shown, channels 33 in the platen 30 are aligned with and in fluid communication with channels 95 in the polishing pad 20. Further, channels 34 in the platen 30 are aligned with and in fluid communication with channels 96 in the polishing pad 20.

In the embodiment of FIG. 7, a source 701 of a treatment agent 301 is in fluid communication with the channels 33 and 95. Further, a vacuum or negative pressure source 702 is in fluid communication with the channels 34 and 96.

With the structure 700 of FIG. 7 provided, a treatment agent 301 may be delivered from the source 701, through the aligned channels 33 and 95, and released at or injected at the treatment surface 21.

Further, used or waste material, such as used treatment agent and debris or by-products may be removed from treatment surface 21 through aligned channels 96 and 34 to the source 702 of the vacuum or negative pressure.

In some embodiments, the treatment agent may comprise a fresh CMP slurry. Generally, a slurry refers to a liquid-solid fluid mixture with a specific gravity greater than 1. Thus, source 701 and channels 33 and 95 provide a supply of fresh slurry 301 and may be considered to form a bottom-up fresh slurry supply that increases slurry flow distribution at the interface of the wafer 15 and the polishing pad 20, i.e., at treatment surface 21. In such embodiments, the source 702 and channels 34 and 96 serve as a top-down waste slurry drain for removing waste slurry 302 to reduce unwanted scratching and remain defects.

In certain embodiments, the treatment agent 301 may comprise a clean chemical system, an abrasive source system to regulate mechanical abrasion of the wafer 15, an additive source system to increase or decrease chemical reaction on the wafer 15, or a peroxide solution system to oxidize and polish metal, such as H2O2.

Figure 8:
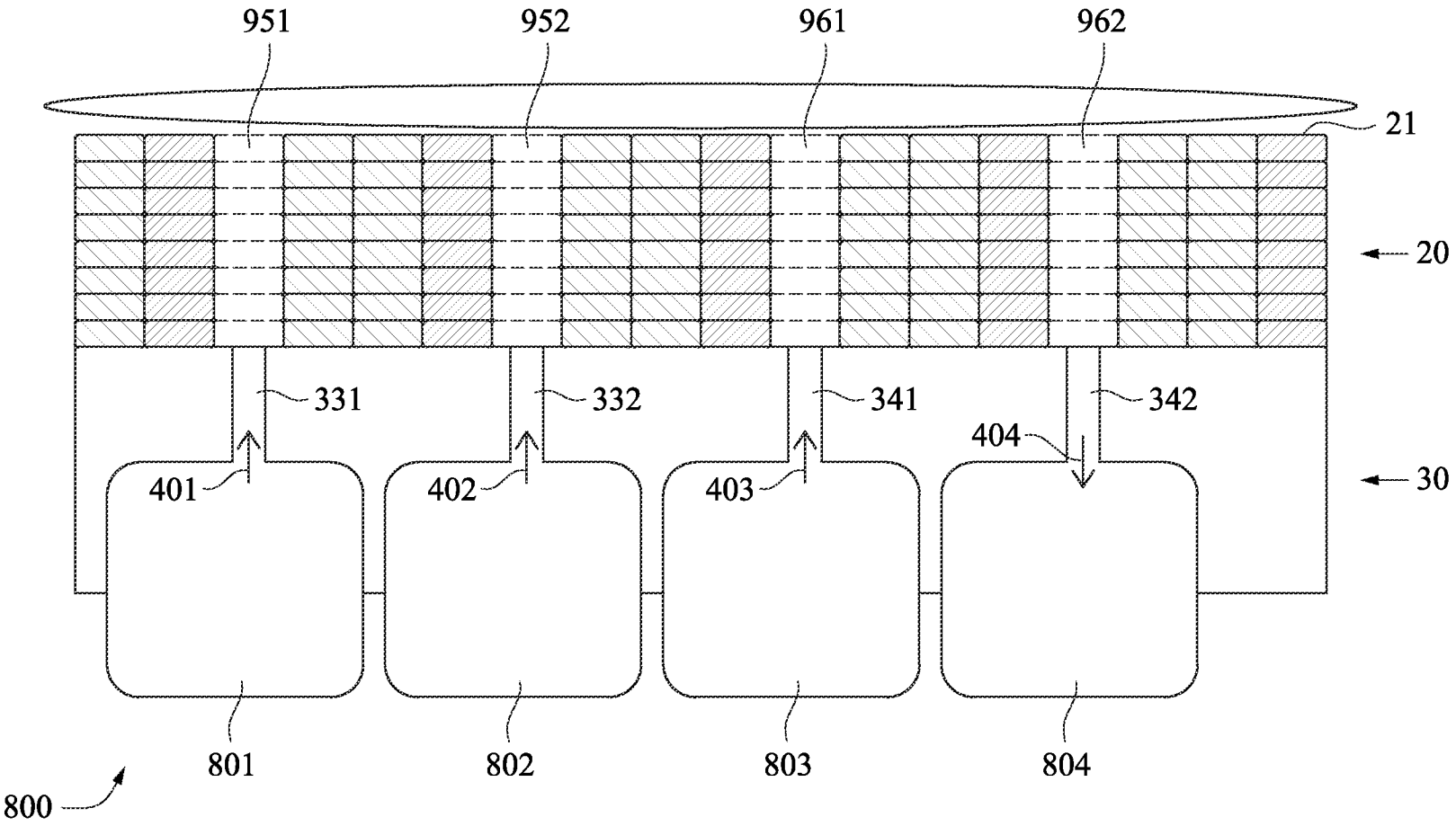
FIG. 8 is cross-sectional schematic view of a wafer, polishing pad, and platen at a polishing location in accordance with some embodiments.

Referring to FIG. 8, another embodiment of a rotatable structure 800 including a polishing pad 20 and platen 30 is illustrated while supporting a wafer 15. In FIG. 8, the polishing pad 20 and platen 30 are provided with the structure of FIG. 7. However, in FIG. 8, a first treatment agent source 801 is in fluid communication with and provides a treatment agent 401 to the treatment surface 21 through aligned channels 331 and 951; a second treatment agent source 802 is in fluid communication with and provides a treatment agent 402 to the treatment surface 21 through aligned channels 332 and 952; a third treatment agent source 803 is in fluid communication with and provides a treatment agent 403 to the treatment surface 21 through aligned channels 341 and 961; and a source 804 of a vacuum or negative pressure is in fluid communication with the treatment surface 21 through aligned channels 342 and 962 to remove a waste stream 404.

With the structure 800 of FIG. 8, more than one selected treatment agent 801, 802, and 803 can be delivered to the treatment surface 21. For example, any combination of a CMP slurry, a clean chemical system, an abrasive source system to regulate mechanical abrasion of the wafer 15, an additive source system to increase or decrease chemical reaction on the wafer 15, and/or a peroxide solution system to oxidize and polish metal, such as H2O2, may be delivered to the surface 21. Also, such treatment agents may be delivered to the surface according to a schedule, i.e., in a specific order and duration.

While FIG. 7 illustrates a single treatment agent source and a single drain source and FIG. 8 illustrates three treatment agent sources and a single drain source, it is contemplated that any desired and suitable number of treatment agent sources and drain sources may be provided in fluid communication with the surface 21 to provide the desired treatment. For example, a polish pad 20 and platen 30 may be provided to deliver a single slurry (1S) to the surface 21; two slurries (2S) to the surface 21; one slurry and one clean chemical system (1S1C) to the surface 21; one clean chemical system (1C) to the surface 21; one slurry and one abrasive source (1SAb) to the surface 21; one slurry and one additive source (1SAd) to the surface 21; one slurry and one peroxide solution source (1SH) to the surface 21; and each of these embodiments may be provided with or without a drain to a drain source.

Further cross-referencing FIGS. 1, 7, and 8, it is contemplated that different modules 200, such as modules 201, 202, 203, and 204, may be provide with different arrangements of treatment agent sources and drain sources. For example, a tool 100 having a main polish module 201 and a buff module 203 may be provided as: a module 201 with a single slurry source (1S/P1); a module 203 with a single slurry source (1S/P2); each of module 201 and module 203 with single slurry sources (1S/P1+P2); a module 201 with a single slurry source and a single drain source (1S/SD/P1); a module 203 with a single slurry source and a single drain source (1S/SD/P2); each of module 201 and module 203 with single slurry source and single drain sources (1S/SD/P1+P2); a module 201 with two slurry sources (2S/P1); a module 203 with two slurry sources (2S/P2); each of modules 201 and 203 with two slurry sources (2S/P1+P2); a module 201 with two slurry sources and a drain source (2S/SD/P1); a module 203 with two slurry sources and a drain source (2S/SD/P2); each of modules 201 and 203 with two slurry sources and a drain source (2S/SD/P1+P2); a module 201 with a single slurry source and a single clean chemistry source (1S1C/P1); a module 203 with a single slurry source and a single clean chemistry source (1S1C/P2); each of module 201 and module 203 with single slurry sources and single clean chemistry sources (1S1C/P1+P2); a module 201 with a single slurry source, a single clean chemistry source, and a drain source (1S1C/SD/P1); a module 203 with a single slurry source, a single clean chemistry source, and a drain source (1S1C/SD/P2); each of module 201 and module 203 with single slurry sources, single clean chemistry sources, and drain sources (1S1C/SD/P1+P2); a module 201 with a single clean chemistry source (1C/P1); a module 203 with a single clean chemistry source (1C/P2); each of module 201 and module 203 with single clean chemistry sources (1C/P1+P2); a module 201 with a single clean chemistry source and a single drain source (1C/SD/P1); a module 203 with a single clean chemistry source and a single drain source (1D/SD/P2); each of module 201 and module 203 with single clean chemistry source and single drain sources (1C/SD/P1+P2); a module 201 with a single slurry source and a single abrasive source (1SAb/P1); a module 203 with a single slurry source and a single abrasive source (1SAb/P2); each of module 201 and module 203 with single slurry sources and single abrasive sources (1SAb/P1+P2); a module 201 with a single slurry source, a single abrasive source, and a drain source (1SAb/SD/P1); a module 203 with a single slurry source, a single abrasive source, and a drain source (1SAb/SD/P2); each of module 201 and module 203 with single slurry sources, single abrasive sources, and drain sources (1SAb/SD/P1+P2); a module 201 with a single slurry source and a single additive source (1SAd/P1); a module 203 with a single slurry source and a single additive source (1SAd/P2); each of module 201 and module 203 with single slurry sources and single additive sources (1SAd/P1+

P2); a module 201 with a single slurry source, a single additive source, and a drain source (1SAd/SD/P1); a module 203 with a single slurry source, a single additive source, and a drain source (1SAd/SD/P2); each of module 201 and module 203 with single slurry sources, single additive sources, and drain sources (1SAd/SD/P1+P2); a module 201 with a single slurry source and a single peroxide source (1SH/P1); a module 203 with a single slurry source and a single peroxide source (1SH/P2); each of module 201 and module 203 with single slurry sources and single peroxide sources (1SH/P1+P2); a module 201 with a single slurry source, a single peroxide source, and a drain source (1SH/SD/P1); a module 203 with a single slurry source, a single peroxide source, and a drain source (1SH/SD/P2); and each of module 201 and module 203 with single slurry sources, single peroxide sources, and drain sources (1SH/SD/P1+P2). While these combinations are provided, any desired combination of sources and drains may be provided.

Figure 9:
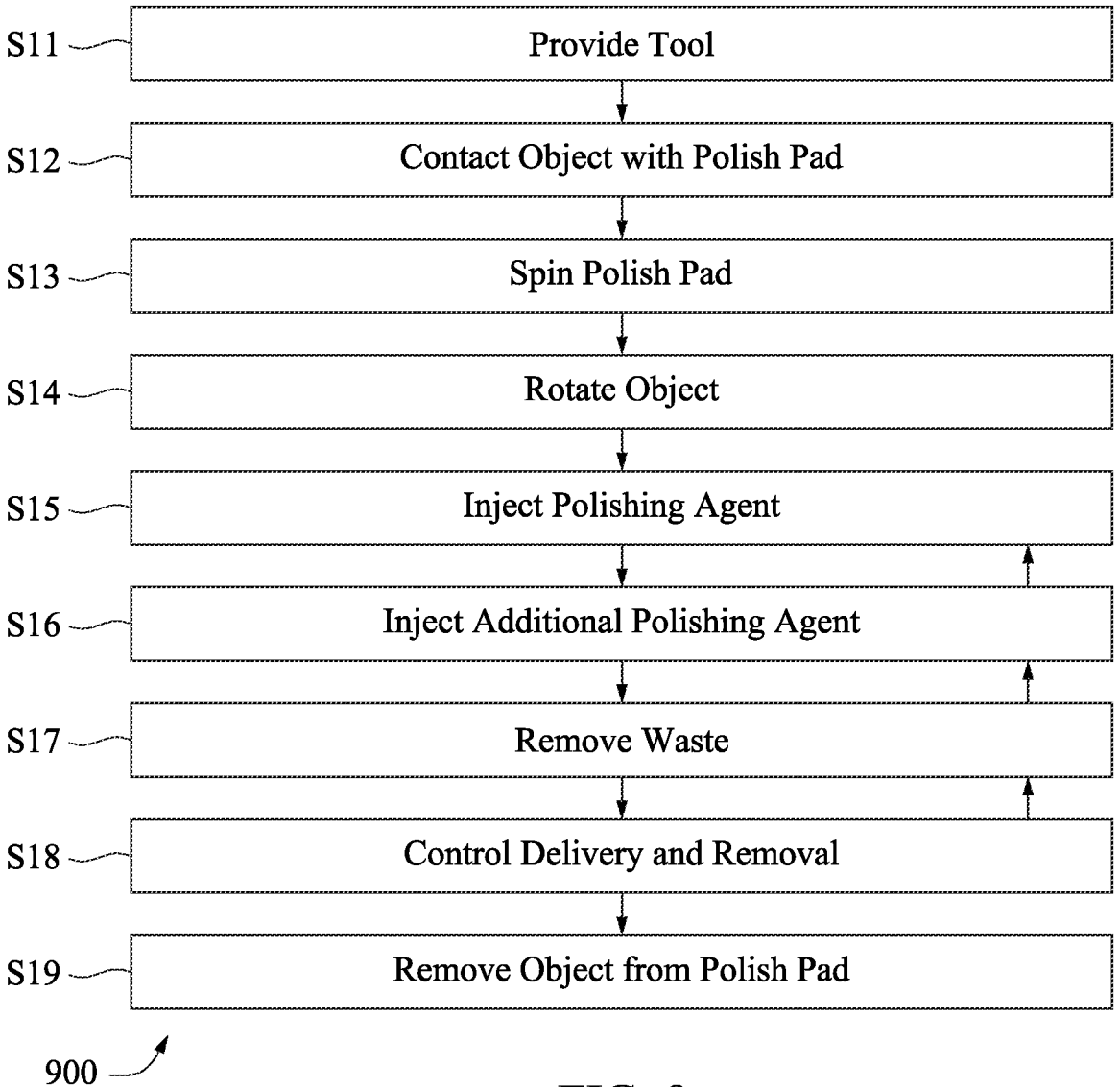
FIG. 9 is a flow chart illustrating a method for polishing an object, such as while manufacturing a semiconductor device, in accordance with some embodiments.

Referring to FIG. 9, a flow chart of a method 900 for polishing an object 15, such as while manufacturing a semiconductor device, is illustrated. Cross-referencing FIG. 9 with FIGS. 1-8, method 900 includes providing a polishing tool 100 including a rotatable polishing pad 20 having an upper surface 21 at S11.

Further, method 900 includes contacting the object 15 with the surface 21 of the polishing pad 20 at S12. For example, a wafer 15 may be picked up and moved into contact with the polishing pad 20 as illustrated in FIGS. 3-5.

Method 900 also includes spinning the polishing pad 20 at S13, and as indicated in FIG. 2.

In some embodiments, method 900 includes rotating the object 15 at S14, as further indicated in FIGS. 2 and 6.

Further, method 900 includes injecting a polishing agent 300 through the polishing pad 20 to the surface 21 at S15. In some embodiments, S13, S14, and S15 may be performed simultaneously.

Further, method 900 may include injecting a second polishing agent 400, or any desired number of agents, through the polishing pad 20 to the surface 21 at S16, during or after injecting the polishing agent 300 through the polishing pad 20 to the surface 21 at S15.

Also, method 900 may include removing a waste stream 302 from the polishing surface 21 through the polish pad 20 at S17. The removal of the waste stream 302 may be selectively performed, such as to remove a first polishing agent before a second polishing agent is introduced or continuously with the application of polishing agents.

Method 900 further includes, at S18, controlling the rate of delivering selected polishing agents and removing waste streams to optimize polishing of the wafer 15.

When the desired polished surface is achieved on the object, the method 900 may include removing the object from the polish pad at S19.

As described herein, a tool and method for polishing wafers are provided with better control of WiW and WiZ thickness uniformity and a reduction in CMP-induced defects, such as through the use of a bottom-up fresh slurry supply and a top-down waste slurry drain system during polishing, and/or through the use of a three-dimensional printed polish pad design. Bottom-up fresh slurry supply (FSH) may improve and/or increase slurry flow distribution. Top-down waste slurry drain may reduce scratch and remain defects.

As described, seven different slurry and chemical supply systems are contemplated through the three-dimensional printed polish pad, including a single slurry system, a double slurry system, a double slurry and single clean chemical system, a single clean chemical system, and single slurry and single abrasive system, a single slurry and single additive system, and a single slurry and H2O2 (peroxide) solution system. Other combinations are contemplated. Further, drain systems may be incorporated into each of the supply designs in the three-dimensional printed pad.

Also, at least three types of polishing strategy are contemplated. For example, a main polish module (P1) may be provided with a design described above, a buff module (P2) may be provided with a design described above, and/or both a main polish module and a buff module (P1+P2) may be provided with an independently selected design described above.

Through the use of the tool and method described herein, a CMP process may be provided with more uniform slurry and chemical flow, healthier downforce settings, increased WiW uniformity, cost-savings resulting from use of less slurry or chemical, a reduction in scratch defectivity, a reduction in CMP-induced defectivity. With less scratch defects and more uniform WiW thickness, chip yield and IC device performance will be sharply improved.

In one embodiment, a method for polishing a wafer includes contacting a surface of the wafer to a polishing pad at an interface; rotating the wafer and/or the pad; and delivering a series of selected treatment agents to the interface and removing waste from the interface through channels extending through the pad, while controlling a rate of delivering the selected polishing agents and removing the waste streams through the channels formed in the pad to optimize polishing of the wafer.

In an embodiment of the method, the polishing pad is formed with columns of a first material, and columns of a second material harder than the first material.

In an embodiment of the method, the polishing pad is formed with columns of a first material, columns of a second material harder than the first material, and columns of voids, wherein the channels are formed by the columns of voids.

In an embodiment of the method, the polishing pad is formed by three-dimensional printing.

In an embodiment of the method, the polishing pad is located on a platen, and wherein the series of selected treatment agents passes through the platen into the polishing pad.

In an embodiment of the method, the method comprises rotating the wafer and rotating the pad.

In an embodiment of the method, the selected treatments agents are selected from the group consisting of a chemical mechanical polishing slurry, a cleaning chemical, an abrasive source, an additive source, and a peroxide solution.

In another embodiment, a method for manufacturing a semiconductor device includes contacting a surface of a wafer to a pad at an interface; rotating the wafer and/or the pad; and delivering a treatment agent to the interface through a channel extending through the pad.

In an embodiment of the method, the treatment agent is a chemical mechanical polishing slurry.

In an embodiment of the method, the pad is located on a platen, and the pad and the platen have aligned channels through which the treatment agent is delivered to the interface.

In an embodiment, the method further includes removing waste from the interface through a channel extending through the pad.

In an embodiment of the method, the treatment agent is a first treatment agent, and the method further includes delivering a second treatment agent to the interface through the pad. In such an embodiment, the method may further include delivering a third treatment agent to the interface through the pad. In such an embodiment of the method, the first treatment agent is a chemical mechanical polishing slurry, and the second treatment agent is selected from a cleaning chemical, an abrasive source, an additive source, and a peroxide solution.

In another embodiment, a method for polishing an object includes providing a polishing tool including a rotatable polishing pad having an upper surface, wherein a polishing agent is in fluid communication with the upper surface via a channel through the polishing pad; contacting the object with the surface of the polishing pad; and spinning the polishing pad while injecting the polishing agent through the polishing pad to the surface.

In an embodiment of the method, the polishing pad is formed with columns of a first material, columns of a second material harder than the first material, and columns of voids, wherein the polishing agent is injected through the voids.

In an embodiment of the method, the polishing pad is formed by three-dimensional printing.

In an embodiment of the method, the polishing pad is located on a platen, and the polishing agent passes through the platen into the polishing pad.

In an embodiment, the method, further includes removing polishing agent waste from the surface through the polishing pad.

In an embodiment, the method, further includes rotating the object.

In another embodiment, a polishing tool includes a polishing module including: a rotatable platen including a platen channel; a polishing pad located over the rotatable platen and having an upper surface, wherein the polishing pad includes a pad channel in fluid communication with the platen channel; a treatment agent source in fluid communication with the upper surface of the polishing pad through the platen channel and the pad channel; and a polishing head configured to move a wafer into and out of contact with the upper surface of the polishing pad.

In an embodiment of the polishing tool, the rotatable platen is a main polish platen or a chemical buff platen.

In an embodiment of the polishing tool, the polishing module is a first polishing module, and the polishing tool further includes a second polishing module comprising: a second rotatable platen including a second platen channel; a second polishing pad located over the second rotatable platen and having an upper surface, wherein the second polishing pad includes a second pad channel in fluid communication with the second platen channel; a second treatment agent source in fluid communication with the upper surface of the second polishing pad; and a second polishing head configured to move the wafer into and out of contact with the upper surface of the second polishing pad. In such an embodiment, the rotatable platen of the first polishing module may be a main polish platen, and the second rotatable platen of the second polishing module may be a chemical buff platen.

In an embodiment of the polishing tool, the polishing pad is formed by three-dimensional printing and includes columns of a first material and columns of a second material harder than the first material.

In an embodiment of the polishing tool, the pad channel is a first pad channel; the pad includes a second pad channel; the platen channel is a first platen channel; the platen includes a second platen channel; and the polishing tool is configured to remove waste from the upper surface through the second pad channel and the second platen channel.

In an embodiment of the polishing tool, the pad channel is a first pad channel; the pad comprises a second pad channel; the platen channel is a first platen channel; the platen comprises a second platen channel; and the polishing tool comprises a source of a second treatment agent selected from a cleaning chemical, an abrasive source, an additive source, and a peroxide solution, wherein the source is in fluid communication with the upper surface of the pad through the platen channel and the pad channel.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present.

What is claimed is:

1. A method for polishing a wafer, the method comprising:

contacting a surface of the wafer to a polishing pad at an interface, wherein channels are formed in the pad that extend from a bottom surface to a top surface of the pad;

rotating the wafer and/or the pad; and delivering a series of selected treatment agents to the interface and removing waste from the interface through the channels extending through the pad, while controlling a rate of delivering the selected polishing agents and removing the waste streams through the channels formed in the pad to optimize polishing of the wafer, wherein controlling the rate of delivering the selected polishing agents comprises independently controlling flow rates to different radial zones of the wafer through separate groups of channels, wherein the separate groups of channels are positioned to deliver treatment agents to different radial zones.

2. The method of claim 1, wherein the polishing pad is formed with first columns of a first material, and second columns of a second material harder than the first material, and columns of aligned voids, the columns of aligned voids forming the channels, wherein the first columns and second columns are interspersed between the columns of aligned voids.

3. The method of claim 1, wherein the polishing pad is formed by three-dimensional printing.

4. The method of claim 1, wherein the polishing pad is located on a platen, and wherein the series of selected treatment agents passes through the platen into the polishing pad.

5. The method of claim 1, wherein the method comprises rotating the wafer and rotating the pad.

6. The method of claim 1, wherein the selected treatments agents are selected from the group consisting of a chemical mechanical polishing slurry, a cleaning chemical, an abrasive source, an additive source, and a peroxide solution.

7. A method for polishing an object, the method comprising:

providing a rotatable polishing pad with a pixel-level controlled structure formed by three-dimensional printing and having a top surface and a bottom surface, wherein channels are formed by pixels comprising voids arranged in columns extending through the pad from the bottom surface to the top surface;

providing a polishing tool including the rotatable polishing pad, wherein a polishing agent is in fluid communication with the top surface via the channels through the polishing pad;

contacting the object with the top surface of the polishing pad; and spinning the polishing pad while injecting the polishing agent through the channels in the polishing pad to the top surface.

8. The method of claim 7, wherein the polishing pad is formed with columns of a first material and columns of a second material harder than the first material.

9. The method of claim 7, wherein each pixel has a predetermined hardness value selected from a range of 5 shore A to 80 shore D.

10. The method of claim 7, wherein the polishing pad is located on a platen, and wherein the polishing agent passes through the platen into the polishing pad.

11. The method of claim 7, further comprising removing polishing agent waste from the surface through the channels of the polishing pad.

12. The method of claim 11, further comprising rotating the object.

13. A method for manufacturing a semiconductor device, the method comprising:

contacting a surface of a wafer to a top surface of a pad at an interface, wherein the pad is formed with columns of aligned voids, the columns of aligned voids forming channels defining discrete flow paths that extend continuously from a bottom surface to the top surface of the pad;

rotating the wafer and/or the pad; and delivering a treatment agent to the interface through the channels extending through the pad.

14. The method of claim 13, wherein the treatment agent is a chemical mechanical polishing slurry.

15. The method of claim 13, wherein the pad is located on a platen, wherein the platen includes channels, and wherein the channels of the pad and the channels of the platen are aligned to form pathways through which the treatment agent is delivered to the interface.

16. The method of claim 13, further comprising removing waste from the interface through a second channel of the channels extending through the pad.

17. The method of claim 13, wherein the treatment agent is a first treatment agent, and wherein the method further comprises delivering a second treatment agent to the interface through the pad.

18. The method of claim 17, further comprising delivering a third treatment agent to the interface through the pad.

19. The method of claim 17, wherein the first treatment agent is a chemical mechanical polishing slurry, and wherein the second treatment agent is selected from a cleaning chemical, an abrasive source, an additive source, and a peroxide solution.

20. The method of claim 13, further comprising controlling the rate of delivering the treatment agent to the interface by independently controlling flow rates to different radial zones of the surface of the wafer through separate groups of channels, each group of channels being positioned to supply a corresponding radial zone of the wafer.

* * * * *